US008820337B2

(12) United States Patent
Hsieh et al.

(10) Patent No.: US 8,820,337 B2
(45) Date of Patent: Sep. 2, 2014

(54) ELASTIC FORCE MAGNIFYING STRUCTURE OF SELF-OPENING/CLOSING UMBRELLA

(71) Applicant: Chin-Sung Ko, Changhua County (TW)

(72) Inventors: I-Ho Hsieh, Changhua County (TW); Kwing-Yuk Sze, Changhua County (TW)

(73) Assignee: Chin-Sung Ko, Changhua County (TW)

( * ) Notice: Subject to any disclaimer, the term of this patent is extended or adjusted under 35 U.S.C. 154(b) by 0 days.

(21) Appl. No.: 13/783,413

(22) Filed: Mar. 4, 2013

(65) Prior Publication Data

US 2014/0041701 A1 Feb. 13, 2014

(30) Foreign Application Priority Data

Aug. 8, 2012 (CN) ..... 2012 2 0390404 U

(51) Int. Cl.
*A45B 25/16* (2006.01)
*A45B 25/14* (2006.01)

(52) U.S. Cl.
CPC ..... *A45B 25/16* (2013.01); *A45B 25/143* (2013.01)
USPC ..... 135/22; 135/24; 135/25.4; 135/40

(58) Field of Classification Search
CPC ..... A45B 25/143; A45B 25/14; A45B 25/16; A45B 25/006; A45B 19/04; A45B 19/10
USPC ..... 135/22, 24, 25.1, 25.4, 25.33, 40
See application file for complete search history.

(56) References Cited

U.S. PATENT DOCUMENTS

| | | | | |
|---|---|---|---|---|
| 5,247,955 | A * | 9/1993 | Wu | 135/22 |
| 5,297,571 | A * | 3/1994 | Chu et al. | 135/24 |
| 5,318,067 | A * | 6/1994 | Day | 135/22 |
| 5,361,792 | A * | 11/1994 | Lin et al. | 135/24 |
| 5,483,985 | A * | 1/1996 | Yu | 135/22 |
| 5,533,541 | A * | 7/1996 | Cheng et al. | 135/22 |
| 5,617,889 | A * | 4/1997 | Wu | 135/22 |
| 5,791,359 | A * | 8/1998 | Lin et al. | 135/24 |
| 6,170,498 | B1 * | 1/2001 | Wu | 135/24 |
| 6,810,894 | B2 * | 11/2004 | Chen | 135/22 |
| 2009/0133729 | A1 * | 5/2009 | Chong | 135/20.3 |

* cited by examiner

*Primary Examiner* — Winnie Yip
(74) *Attorney, Agent, or Firm* — Leong C. Lei

(57) ABSTRACT

The present invention provides an elastic force magnifying structure of self-opening/closing umbrella. The umbrella includes a central post that comprises an inner tube, an intermediate tube, and an outer tube telescopically fit to each other. The central post receives a primary spring received therein. The elastic force magnifying structure includes an elastic force increasing spring arranged inside the outer tube. The elastic force increasing spring is coupled by a coupling sleeve to the primary spring to serve as an extension thereof.

1 Claim, 5 Drawing Sheets

ELASTIC FORCE MAGNIFYING STRUCTURE OF SELF-OPENING/CLOSING UMBRELLA

TECHNICAL FIELD OF THE INVENTION

The present invention generally relates to the technical field of self-opening/closing umbrella, and more particularly to an improvement of the structure of a central post of self-opening/closing umbrella.

DESCRIPTION OF THE PRIOR ART

A self-opening/closing umbrella comprises an extendable central post of which extension is achieved by a primary spring contained inside the central post. However, the primary spring is physically constrained by the limited space inside an inner tube of the central post and thus, the elastic force provided by the spring is generally poor. Specifically, the primary spring, which is often a coil spring, has a coil outside diameter that is limited by the inside diameter of the inner tube of the central post and it is not possible to use a substitute spring that has a lager outside diameter and the thus greater elastic force. Further, to maintain smooth movement of a bullet head that is movably receive in the central post, the wire that makes the spring is of a diameter that is constrained by the size of the bullet head, making it not possible to use a spring made of a wire of a larger wire diameter and thus having a greater elastic force. In addition, since the internal space available after the spring is compressed is limited, the number of turns of the primary spring is also constrained. All these constraining factors collectively lead to poor elastic force of the primary spring of the conventional self-opening/closing umbrellas and consequently, it often occurs that the umbrellas cannot be smoothly opened to the full extent. Such a known structure is apparently deficient and impractical and further improvement is desired.

SUMMARY OF THE INVENTION

In view of the shortcomings of the central post of the known self-opening/closing umbrellas, the present invention aims to provide two elastic force magnifying structures for self-opening/closing umbrellas in order to overcome the technical deficiency of poor elastic force of the conventionally used umbrella central posts.

To solve the technical problems, the present invention adopts a technical solution that provides an elastic force magnifying structure of self-opening/closing umbrella. The umbrella comprises a central post that comprises an inner tube, an intermediate tube, and an outer tube telescopically fit to each other. The central post receives a primary spring received therein. The elastic force magnifying structure comprises an elastic force increasing spring arranged inside the outer tube. The elastic force increasing spring is coupled by a coupling sleeve to the primary spring to serve as an extension thereof.

The coupling sleeve has a top end forming an inwardly-projecting inward flange. The coupling sleeve is fit over a top end of the primary spring so that the inward flange is set in engagement with and supports the primary spring. The coupling sleeve has a bottom end forming an outward-projecting outward flange. The elastic force increasing spring is fit over the coupling sleeve so that a bottom end of the elastic force increasing spring is in engagement with and supported by the outward flange. The elastic force increasing spring has an outside diameter that is spaced from an inside circumferential surface of the outer tube and an inside diameter that is spaced from an outside circumferential surface of the coupling sleeve.

An outer tube early launching spring is arranged between the outward flange of the coupling sleeve and a top end of the intermediate tube. The outer tube early launching spring has a spring force that is smaller than the spring force of the elastic force increasing spring.

The outward flange of the coupling sleeve is provided with an opening formed therein to receive a top end of the outer tube early launching spring to fit therein.

The outer tube receives therein a pull cable sleeve having a bottom end fit in the primary spring.

The coupling sleeve has a top end forming an outwardly-projecting outward flange. The primary spring has a top end fit over the coupling sleeve so that the outward flange is in engagement with and supports the top end of the primary spring. The coupling sleeve has a bottom end forming an inwardly-projecting inward flange. The coupling sleeve is fit over a bottom end of the elastic force increasing spring so that the inward flange is in engagement with and supports the bottom end of the elastic force increasing spring. The elastic force increasing spring has an outside diameter that is spaced from an inside circumferential surface of the coupling sleeve.

The intermediate tube has a top end to which an intermediate plug is mounted to support the top end of the primary spring. A secondary spring is supported between the intermediate plug and the coupling sleeve. The secondary spring has an outside diameter that is spaced from an inside circumferential surface of the outer tube. The secondary spring has a top end fit over and encompassing the coupling sleeve and in engagement with and supported by the outward flange.

In summary, the present invention comprises a coupling sleeve that is arranged inside an outer tube of the umbrella central post and is coupled to a top end of a primary spring and comprises an elastic force increasing spring that is additionally provided and connected to the coupling sleeve, whereby the overall elastic force for opening the umbrella is magnified and the spring forces of the two springs counteract each other in collapsing the umbrella so that the effort required for collapsing the umbrella is reduced, making the umbrella more practical in use.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
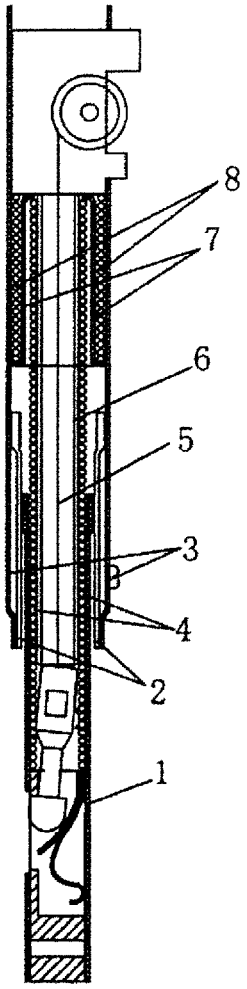
FIG. 1 is a schematic view showing an umbrella according to a first embodiment of the present invention in a completely collapsed condition.
Figure 2:
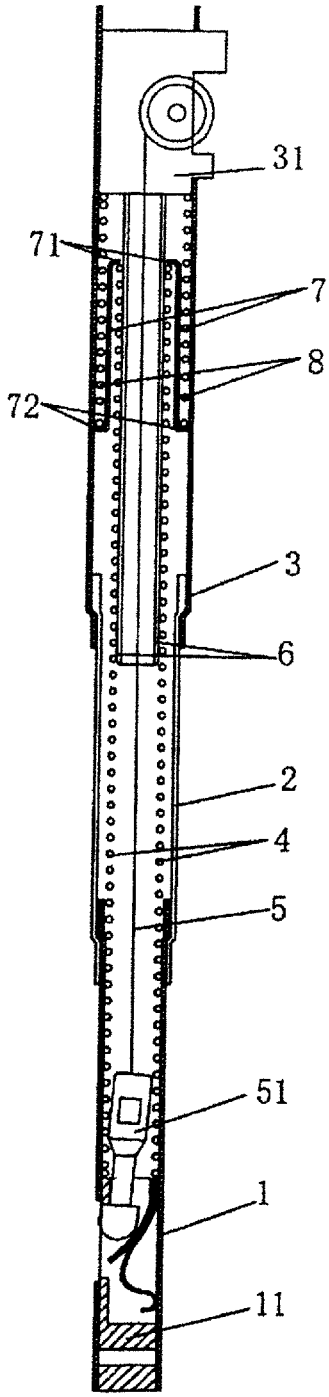
FIG. 2 is a schematic view showing the umbrella of the first embodiment of the present invention in an expanded condition.
Figure 3:
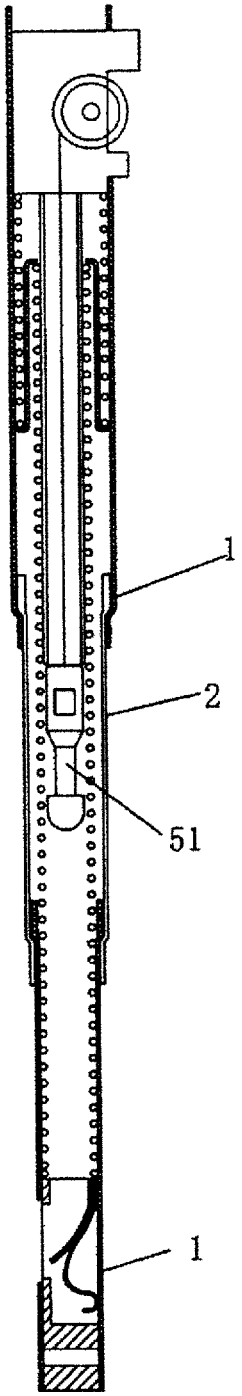
FIG. 3 is a schematic view showing the umbrella of the first embodiment of the present invention in a canopy closed condition.
Figure 4:
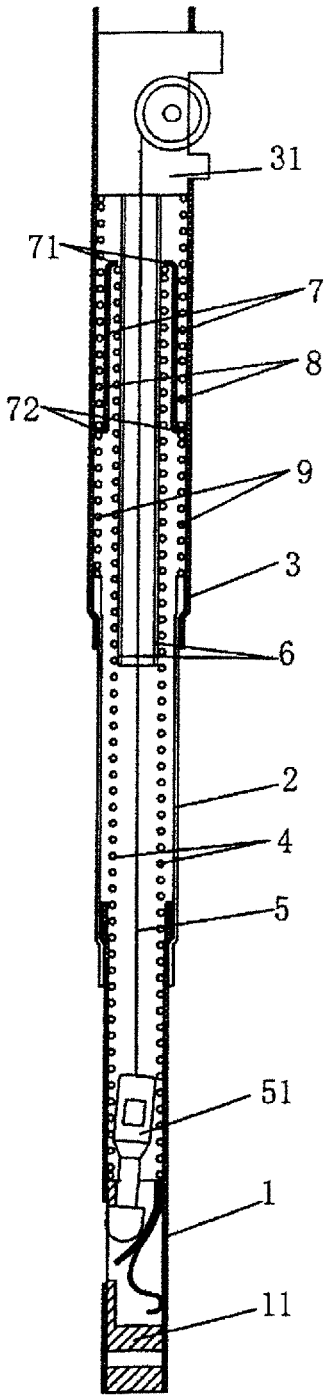
FIG. 4 is a schematic view showing the umbrella of the first embodiment of the present invention in which an early launching spring is included in a central post of the umbrella.

FIGS. 1, 2, and 3 illustrate a first embodiment of the present invention. The present invention provides a self-opening/closing umbrella, which comprises a central post and a primary spring 4 that can be of the same structures as those included in a conventional umbrella. The central post is composed of an inner tube 1, an intermediate tube 2, and an outer tube 3 that are telescopically fit to each other. The inner tube 1, which in normal use of the umbrella, is the bottommost one of the three tubes, has a lower open end into which a bottom plug 11 is fit. The outer tube 3, which in normal use of the umbrella, is the topmost one of the three tubes, has a top open end into which a top plug 31 is fit. The central post receives therein the primary spring 4 and also receives therein a pull cable 5 and a pull cable sleeve 6. The pull cable sleeve 6 has a top end fixed to the top plug 31 and a bottom end located inside the intermediate tube 2. Besides the components just described, the present invention additionally comprises a coupling sleeve 7 and an elastic force increasing spring 8 that are arranged inside the outer tube 3. The operation of the self-opening/closing umbrella according to the present invention is generally similar to that of the conventional umbrellas. As shown in FIG. 1, in a completely collapsed condition, the lower end of the outer tube 3 is received into a handle and retained therein. As shown in FIG. 2, when a release button provided on the handle is actuated once, the outer tube 3 is released and stretches out, while a retention head 51 of the pull cable 5 is still secured, whereby under the action of the pull cable 5, a runner is driven upward to complete the expansion of the umbrella. As shown in FIG. 3, when the button of the handle is actuated again, the retention head 51 is released, under the action of collapsing springs arranged on ribs of the umbrella, the umbrella rib and the umbrella canopy are collapsed and closed.

The improvement of the present invention is that the outer tube 3 contains the elastic force increasing spring 8 arranged therein. The elastic force increasing spring 8 is coupled by a coupling sleeve 7 to a top end of the primary spring 4 so as to form an extended form of spring. In other words, with such a way of combining two springs, the overall length of the combined springs is increased as compared to each single spring. The coupling sleeve 7 has a top end forming an inward flange 71 that projects inwardly and a bottom end forming an outward flange 72 that projects outwardly. The coupling sleeve 7 is fit to and encompasses the top end of the primary spring 4 so that the inward flange 71 is in engagement with and supports the top end of the primary spring 4 and prevents the primary spring 4 from sliding off the coupling sleeve 7. The inward flange 71 defines a central bore that is fit over and spaced from an outside circumferential surface of the pull cable sleeve 6 over which the top end of the primary spring is fit. In other words, the top end of the primary spring 4 is supported by the inward flange 71, while an opposite bottom end of the primary spring is supported on the bottom plug 11. The outward flange 72 defines an outer circumference that is spaced from an inside circumferential surface of the outer tube 3. The elastic force increasing spring 8 has a bottom end fit to and encompassing the coupling sleeve 7 and is in engagement with and supported on the outward flange 72. In other words, the outward flange 72 is supported between the outward flange 72 of the coupling sleeve 7 and the top plug 31. The elastic force increasing spring 8 has an outside diameter that forms a gap with respect to the inside surface of the outer tube 3.

Figure 5:
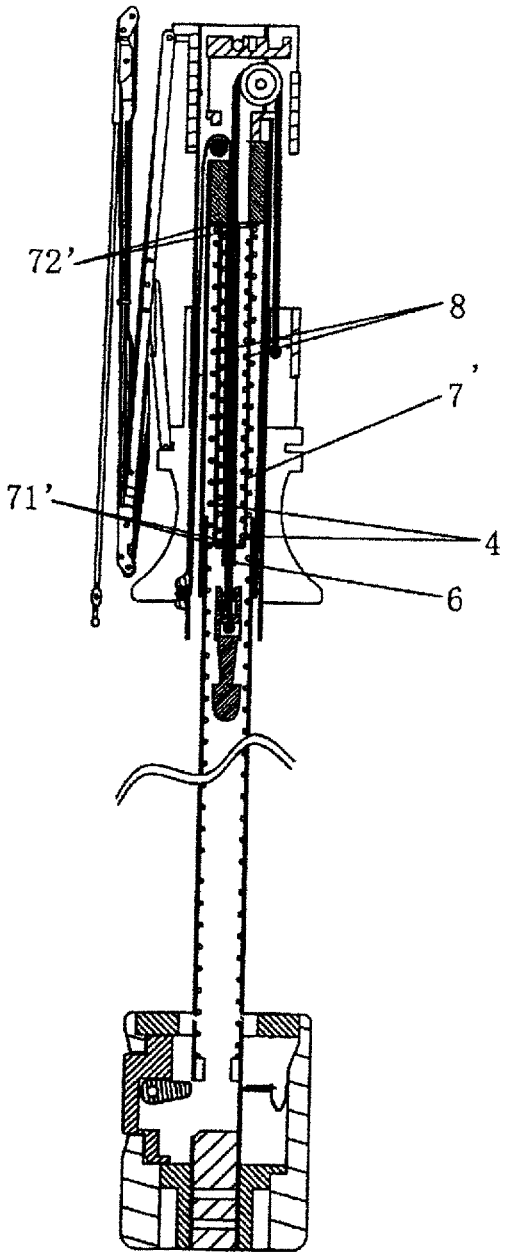
FIG. 5 is a schematic view showing an umbrella according to a second embodiment of the present invention in a canopy closed condition.

Referring to FIG. 5, to make the outer tube 3 stretch out earlier than the intermediate tube 2 when the button is actuated and the umbrella is opened, an outer tube early launching spring 9 is arranged between the outward flange 72 of the coupling sleeve 7 and a top end of the intermediate tube 2. The outer tube early launching spring 9 has a spring force that is smaller than the spring force of the elastic force increasing spring 8. The effective overall elastic force of the umbrella is equal to the spring force of the elastic force increasing spring 8 minus the spring force of the outer tube early launching spring 9 and plus the spring force of the primary spring 4. To ensure secured coupling between the outer tube early launching spring 9 and the coupling sleeve 7, the outward flange 72 of the coupling sleeve 7 is provided with an opening formed therein to receive a top end of the outer tube early launching spring 9 to fit therein in a rotating manner. The best coupling can be achieved by fitting the top end of the outer tube early launching spring 9, followed by relative rotation of one to two turns therebetween.

Figures 6, 6A, 6B:
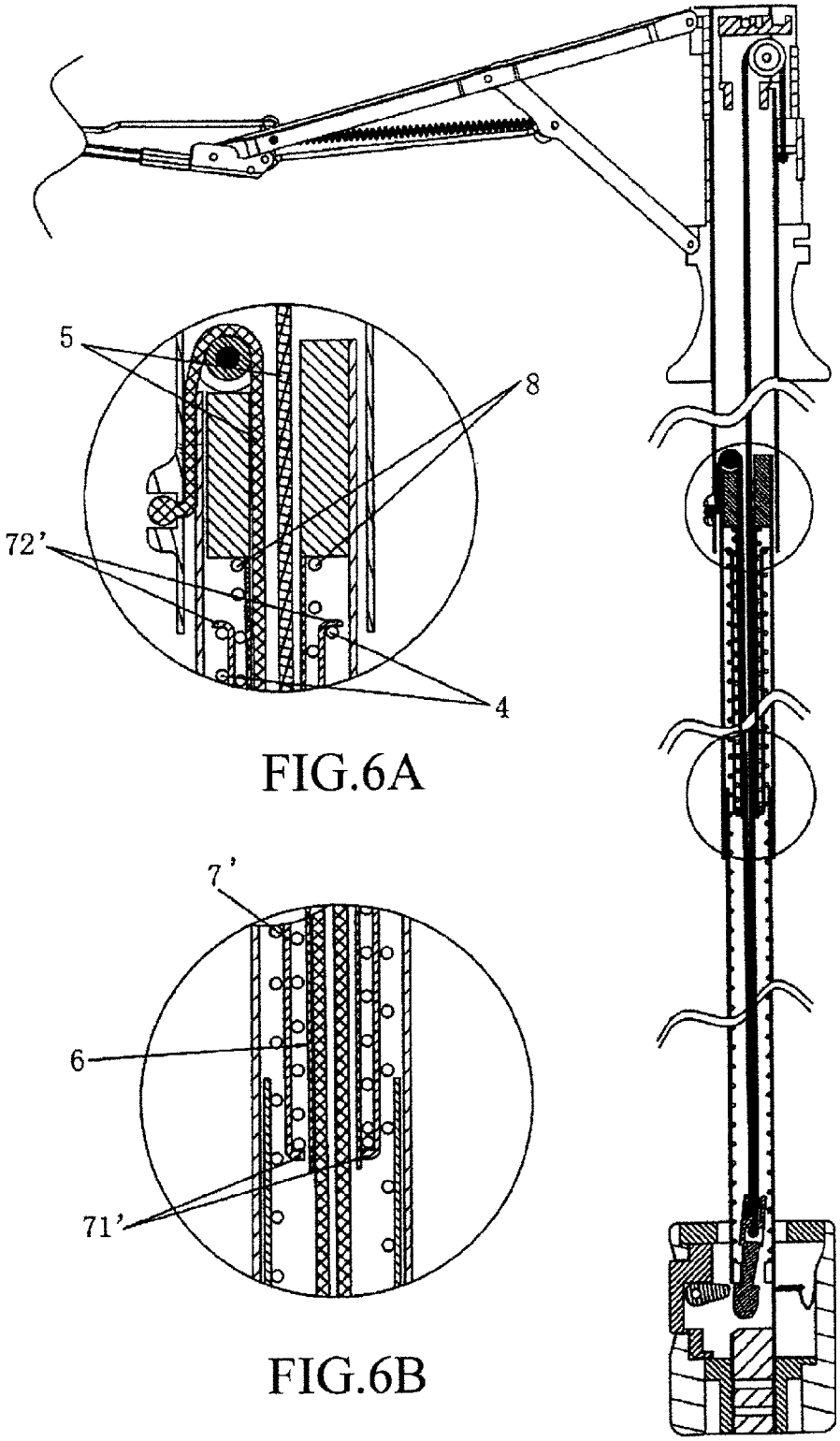
FIG. 6 is a schematic view showing the umbrella of the second embodiment of the present invention in an expanded condition.
FIG. 6A is an enlarged view of a circled portion of FIG. 6.
FIG. 6B is an enlarged view of another circled portion of FIG. 6.

FIGS. 5 and 6 illustrate a second embodiment of the present invention. Although the operation principle is similar to the previous embodiment, the second embodiment comprises a coupling sleeve 7' that is arranged in opposite direction, and is thus up-side down, with respect to the coupling sleeve 7 of the first embodiment and has a bottom end forming an inwardly-projecting inward flange 71' and a top end forming an outwardly-projecting outward flange 72'. The top end of the primary spring 4 is fit over and encompassing the coupling sleeve 7' so that the top end of the primary spring 4 is in engagement with and supported on the outward flange 72' (see FIG. 6A, which is an enlarged view of a circled portion of FIG. 6). The inward flange 71' defines a bore that is fit over and spaced from an outside circumferential surface of the pull cable sleeve 6. The elastic force increasing spring 8 is fit over and encompassing the pull cable sleeve 6 with the bottom end thereof. The top end of the elastic force increasing spring 8 is in engagement with and supported on the top plug 31 (see FIG. 6A). The bottom end of the elastic force increasing spring 8 is in engagement with and supported on the inward flange 71' (see FIG. 6B, which is an enlarged view of another circled portion of FIG. 6). The coupling sleeve 7' has a length smaller than that of the pull cable sleeve 6 and whether the central post stretches out or retracts back, the coupling sleeve 7' is preferably kept encompassing the pull cable sleeve 6 to ensure smooth and obstacle-free extension and retraction of the central post. The central post according to the present invention is applicable to both the first embodiment where the central post includes a single-wire pull cable 5 and the second embodiment where the central post includes a dual-wire pull cable 5.

Figure 7:
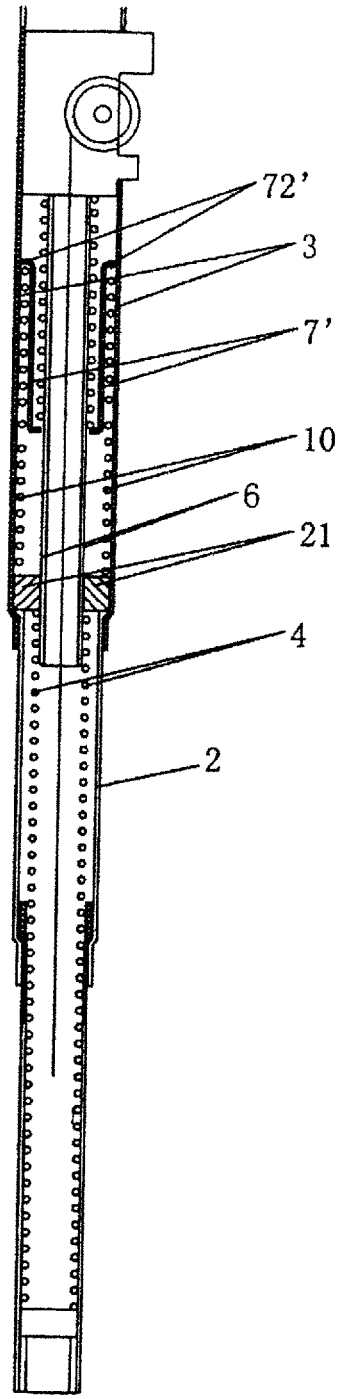
FIG. 7 is a schematic view showing an umbrella according to a third embodiment of the present invention.

FIG. 7 illustrates a third embodiment of the present invention. The intermediate tube 2 has a top end to which an intermediate plug 21 is mounted to support the top end of the primary spring 4. A secondary spring 10 is supported between the intermediate plug 21 and the coupling sleeve 7'. The secondary spring 10 has an outside diameter that is spaced from an inside circumferential surface of the outer tube 3. The secondary spring 10 has a top end fit over and encompassing the coupling sleeve 7' and in engagement with and supported by the outward flange 72'. The outward flange 72' has an outer circumference that is spaced from the inside surface of the outer tube 3.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An elastic force magnifying structure of self-opening/closing umbrella, the umbrella comprising a central post that comprises an inner tube, an intermediate tube, and an outer tube telescopically fit to each other, the central post receiving a primary spring received therein, the elastic force magnifying structure comprising an elastic force increasing spring arranged inside the outer tube, the elastic force increasing spring being coupled by a coupling sleeve to the primary spring to serve as an extension thereof; wherein the coupling sleeve has a top end forming an outwardly-projecting outward flange, the primary spring having a top end fit over the coupling sleeve so that the outward flange is in engagement with and supports the top end of the primary spring, the coupling sleeve having a bottom end forming an inwardly-projecting inward flange, the coupling sleeve being fit over a bottom end of the elastic force increasing spring so that the inward flange is in engagement with and supports the bottom end of the elastic force increasing spring, the elastic force increasing spring having an outside diameter that is spaced from an inside circumferential surface of the coupling sleeve.

* * * * *